US008925127B2

(12) United States Patent
Yan et al.

(10) Patent No.: US 8,925,127 B2
(45) Date of Patent: Jan. 6, 2015

(54) BABY CRIB

(71) Applicants: Wonderland Nurserygoods Company Limited, Central Hong Kong (HK); Graco Children's Products, Inc., Atlanta, GA (US)

(72) Inventors: Fang Xiang Yan, Central Hong Kong (HK); Brandon Michael Burkholder, Atlanta, GA (US); Annette Carol Stella, Dawningtown, PA (US); Matthew Luis Rivera, Mableton, GA (US)

(73) Assignees: Wonderland Nurserygoods Company Limited, Hong Kong (HK); Graco Children's Products, Inc., Atlanta, GA (US)

( * ) Notice: Subject to any disclaimer, the term of this patent is extended or adjusted under 35 U.S.C. 154(b) by 46 days.

(21) Appl. No.: 13/712,500

(22) Filed: Dec. 12, 2012

(65) Prior Publication Data

US 2013/0145545 A1 Jun. 13, 2013

(30) Foreign Application Priority Data

Dec. 13, 2011 (CN) ..... 2011 2 0521253 U

(51) Int. Cl.
*A47D 7/00* (2006.01)

(52) U.S. Cl.
USPC ..... 5/93.1; 5/100; 5/424

(58) Field of Classification Search
USPC ..... 5/93.1, 95, 99.1, 98.1, 101–102, 424
See application file for complete search history.

(56) References Cited

U.S. PATENT DOCUMENTS 1,963,739 A * 6/1934 Engel ..... 5/500

* cited by examiner

*Primary Examiner* — Fredrick Conley
(74) *Attorney, Agent, or Firm* — David I. Roche; Baker & McKenzie LLP

(57) ABSTRACT

A baby crib includes a frame structure, a support base located at a bottom of the frame, the support base including at least one opening, and a cushion pad disposed on the support base, the cushion pad including at least one strap disposed at a position corresponding to the opening. The strap has a first end secured with the cushion pad, and a second end that is formed as a free end adapted to pass through the opening and detachably fasten with the frame structure via a fastener. As the cushion pad is securely held with the support base of the baby crib, injuries caused by accidental lift of the cushion pad can be prevented.

20 Claims, 6 Drawing Sheets

BABY CRIB

CROSS-REFERENCE TO RELATED APPLICATION

This application claims priority to Chinese Patent Application No. 201120521253.5 filed on Dec. 13, 2011, which is incorporated herein by reference.

BACKGROUND

1. Field of the Invention

The present invention relates to baby cribs.

2. Description of the Related Art

Baby cribs can provide an environment in which a child can play and sleep. To provide comfort of use, a mattress is usually disposed on the support base at the bottom of the frame structure. However, some current baby cribs may not have adequate attachments that can effectively fasten the mattress with the support base. As a result, the mattress may be accidentally lifted, and the child may crawl between the mattress and the support base and suffocate.

Therefore, there is a need for an improved baby crib that can be safer in use and overcome at least the foregoing issues.

SUMMARY

The present application describes a baby crib. In one embodiment, the baby crib includes a frame structure, a support base located at a bottom of the frame, the support base including at least one opening, and a cushion pad disposed on the support base, the cushion pad including at least one strap disposed at a position corresponding to the opening. The strap has a first end secured with the cushion pad, and a second end that forms a free end adapted to pass through the opening and detachably fasten with the frame structure via a fastener.

DETAILED DESCRIPTION OF THE EMBODIMENTS

Figure 1:
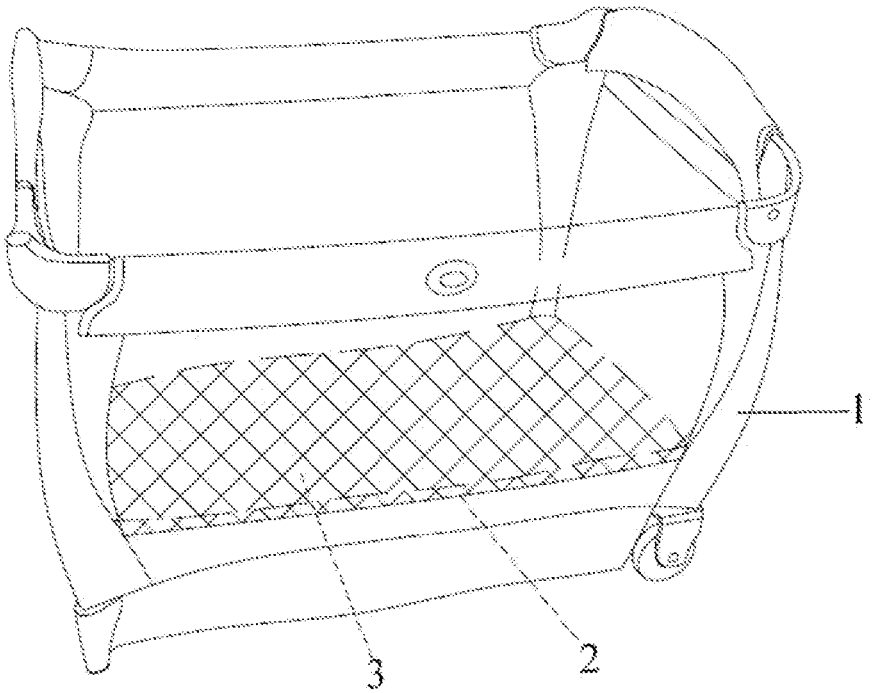
FIG. 1 is a perspective view illustrating an embodiment of a baby crib.
Figure 2:
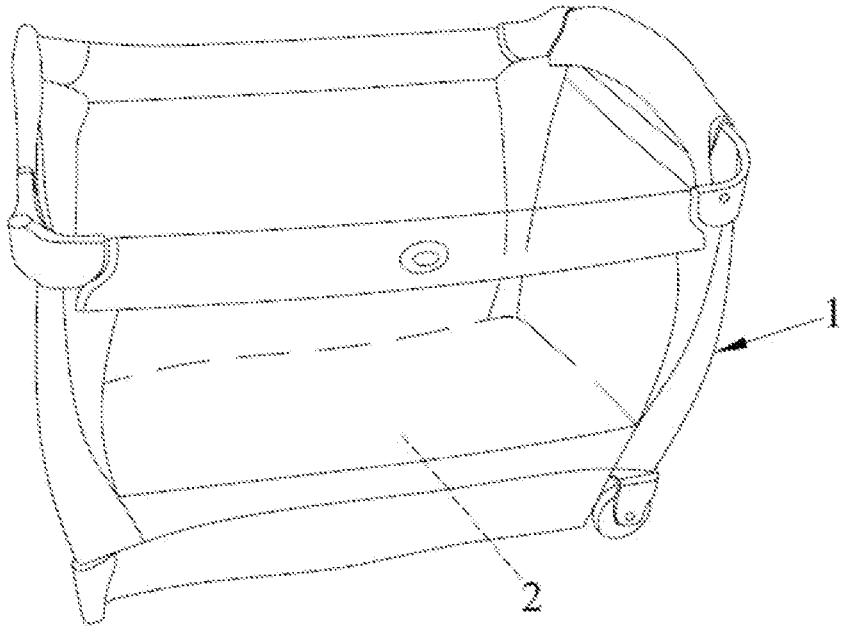
FIG. 2 is a perspective view illustrating a frame structure of the baby crib.
Figure 3:
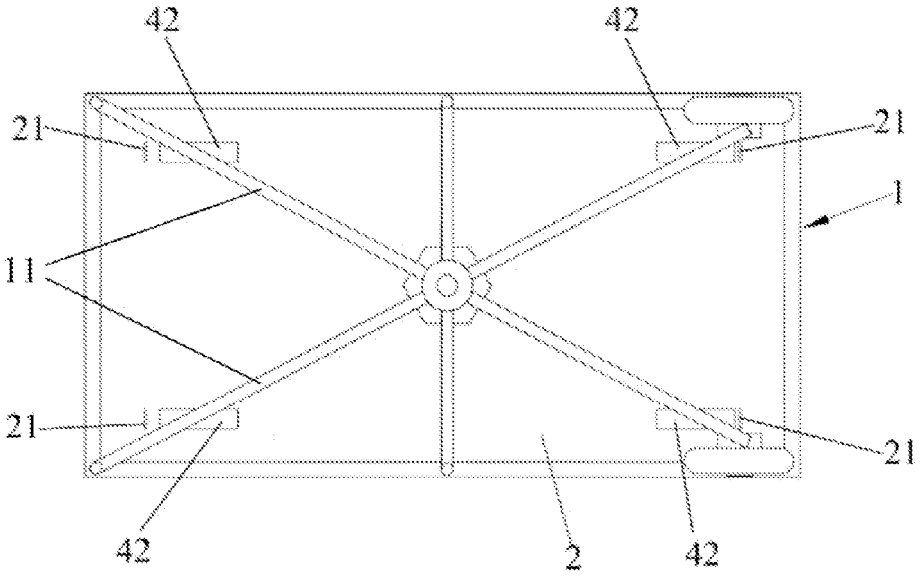
FIG. 3 is a schematic view illustrating a bottom frame of the baby crib.
Figure 4:
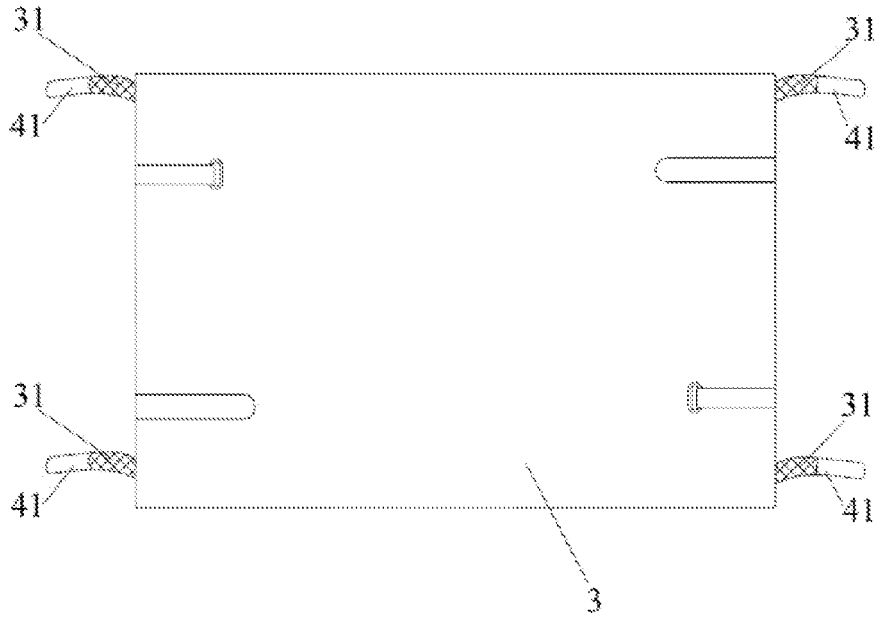
FIG. 4 is a schematic view illustrating the construction of a cushion pad provided in the baby crib.
Figure 5:
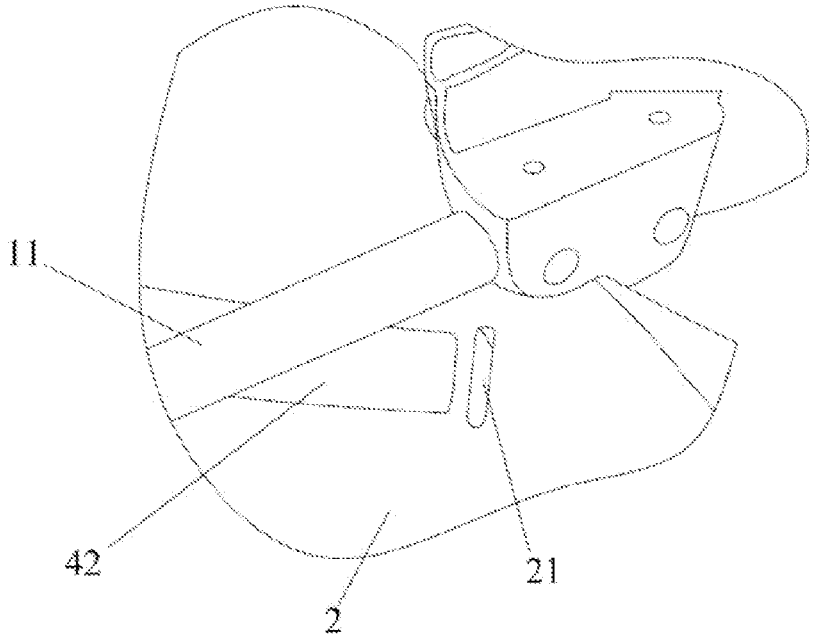
FIG. 5 is a partially enlarged view illustrating a bottom region of the baby crib.
Figure 6:
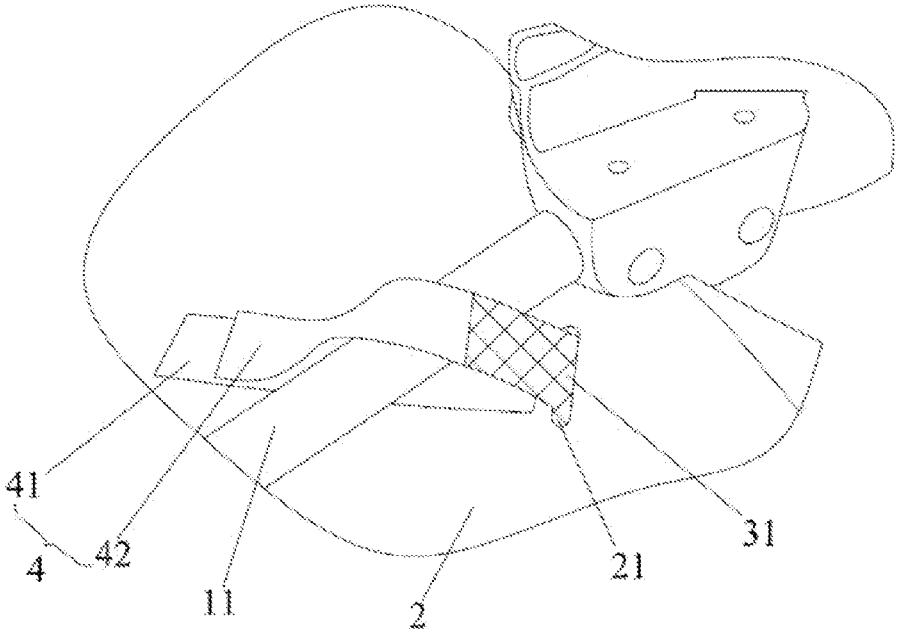
FIG. 6 is a schematic view illustrating the attachment of the cushion pad with a support base of the baby crib.

FIGS. 1-6 are schematic views illustrating an embodiment of a baby crib. The baby crib can include a frame structure 1, a support base 2 and a cushion pad 3. The frame structure 1 can include a bottom frame formed from the assembly of multiple tube segments 11 on which the support base 2 can be supported. The cushion pad 3 in turn can be supported on the support base 2. The support base 2 can have a plurality of openings 21, and the cushion pad 3 can include a plurality of straps 31 disposed at positions respectively corresponding to the openings 21. Each of the straps 31 can have an end secured with the cushion pad 3, and a free end that can pass through one associated opening 21 and detachably hold with one adjacent tube segment 11 or the support base 2 via a fastener 4. In this manner, the cushion pad 3 can be securely attached on the support base 2, which can prevent its accidental lift and consequent child's injuries.

In one embodiment, the openings 21 can be provided at a periphery of the support base 2 to facilitate assembly of the cushion pad 3. In the illustrated example, the support base 2 can have a generally rectangular shape, and exemplary include four openings 21. The four openings 21 may be respectively provided at four corners of the support base 2 for attaching the cushion pad 3 at different locations.

The straps 31 may be made of a flexible and resistant webbing material. Each of the straps 31 can have a first end that is securely sewed with the cushion pad 3, and a second end formed as a free end that can loop through the support base 2 for holding the cushion pad 3 with the support base 2.

In one embodiment, the fastener 4 can be a hook-and-loop fastener (such as the one sold under the brand name Velcro™) including a loop strip 41 and a hook strip 42. The loop strip 41 can be affixed with the free end of each strap 31, whereas the hook strip 42 can be affixed with the support base 2. The free end of each strap 31 may pass through one associated opening 21, wrap around one adjacent tube segment 11, and then attach with the support base 2 by engagement of the hook strip 42 with the loop strip 41. Each of the straps 31 can thereby form an attachment loop that can securely hold the cushion pad 3 with the support base 2. This construction is simple to implement, and convenient to detach for repair, cleaning or change of the cushion pad 3. In alternate embodiments (not shown), the free end of the strap 3 can also pass through the opening 21, and then directly attach with the support base 2 without wrapping around the adjacent tube segment 11.

Figure 7:
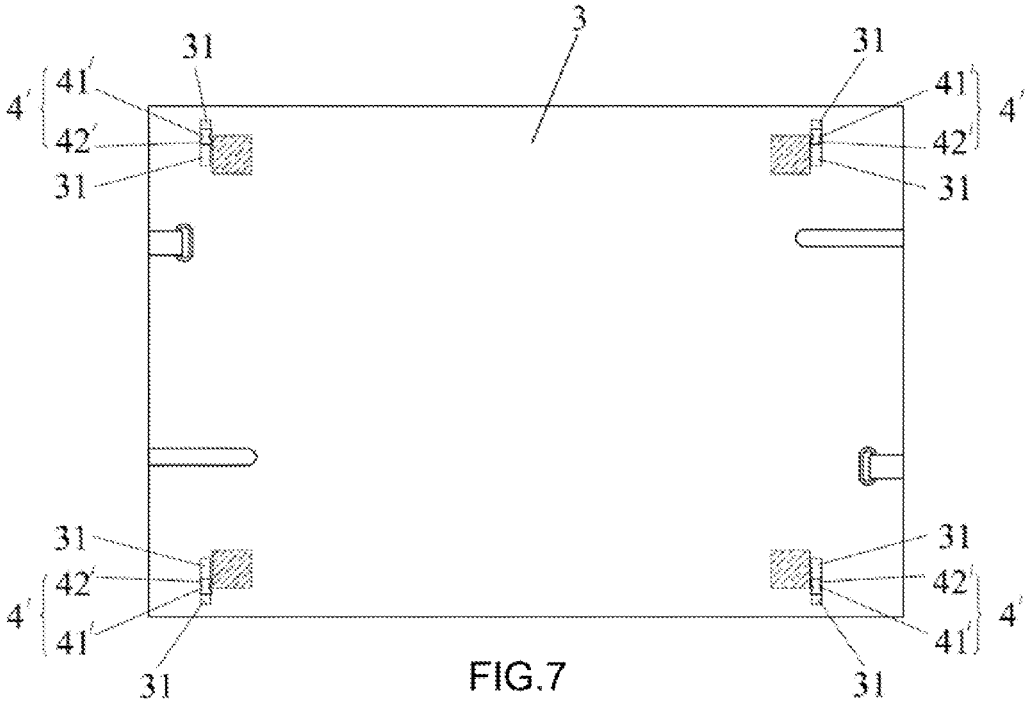
FIG. 7 is a schematic view illustrating the construction of the cushion pad according to another embodiment.
Figure 8:
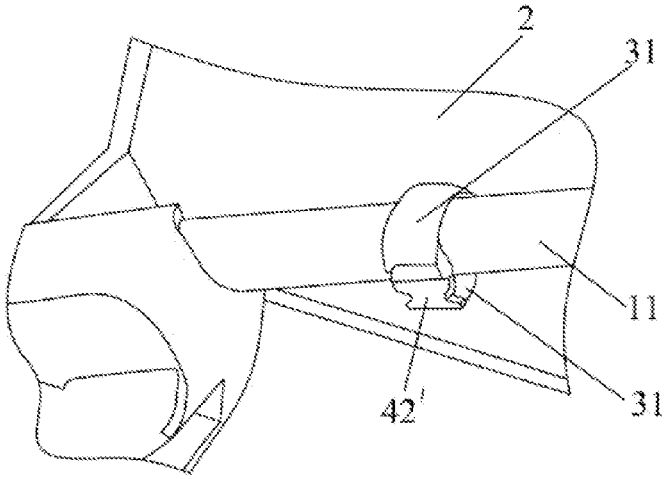
FIG. 8 is a partially enlarged view illustrating the attachment of the cushion pad shown in FIG. 7 with a support base of the baby crib.

FIGS. 7 and 8 are schematic views illustrating another embodiment for attaching the cushion pad 3 with the support base 2. Compared to the previous embodiment, one difference of the baby crib shown in FIGS. 7 and 8 includes two straps 31 that are respectively provided on the cushion pad 3 at positions corresponding to each opening 21. Moreover, the fastener 4' can be a buckle fastener including a male fastener 41' and a female fastener 42' that can insert into each other for locking engagement. The male fastener 41' and the female fastener 42' can be respectively provided at the free ends of the two straps 31. The free ends of the two straps 31 can respectively wrap from two sides of the adjacent tube segment 11, and the male fastener 41' and the female fastener 42' can engage with each other so that the two straps 31 forms a loop that holds the cushion pad 3 with the support base 2.

Figure 9:
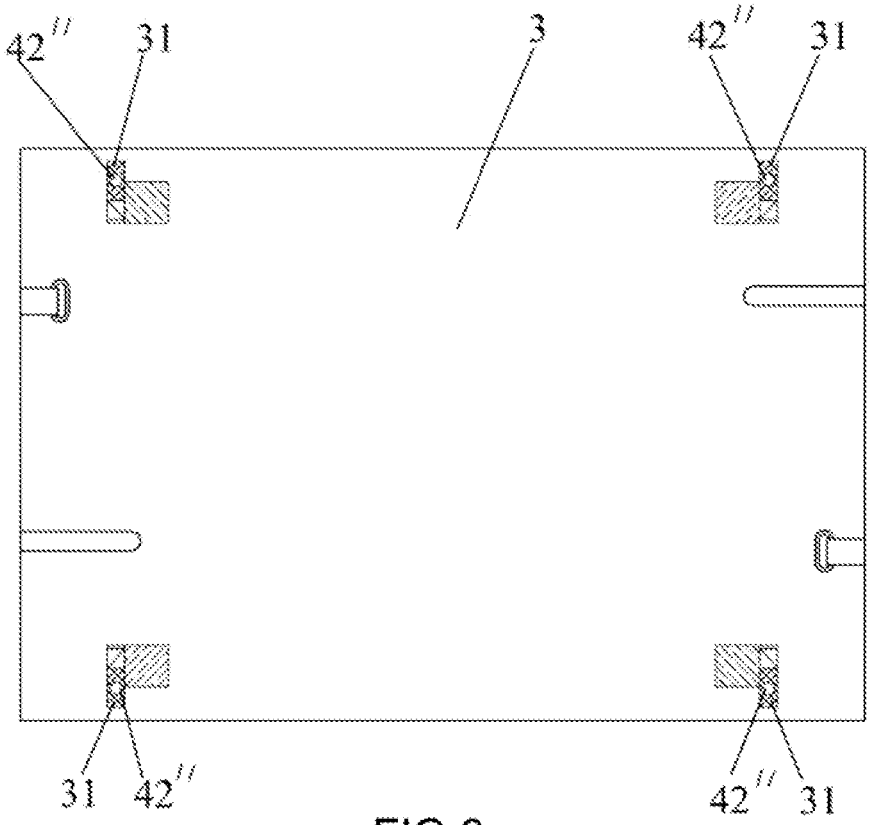
FIG. 9 is a schematic view illustrating the construction of the cushion pad according to another variant embodiment.
Figure 10:
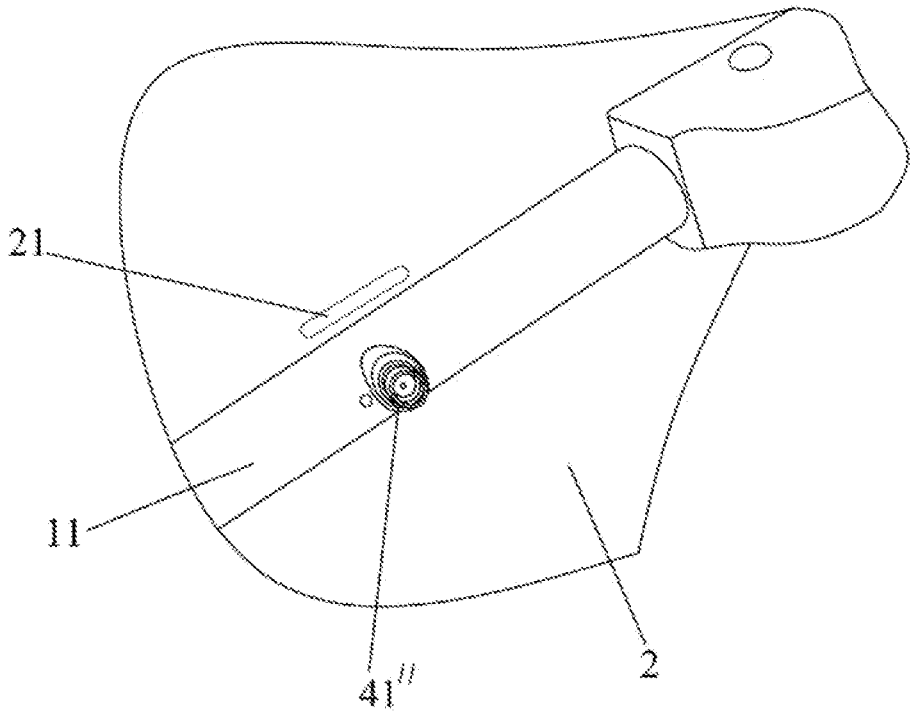
FIG. 10 is a partially enlarged view illustrating a tube segment of a bottom frame provided in the baby crib.
Figure 11:
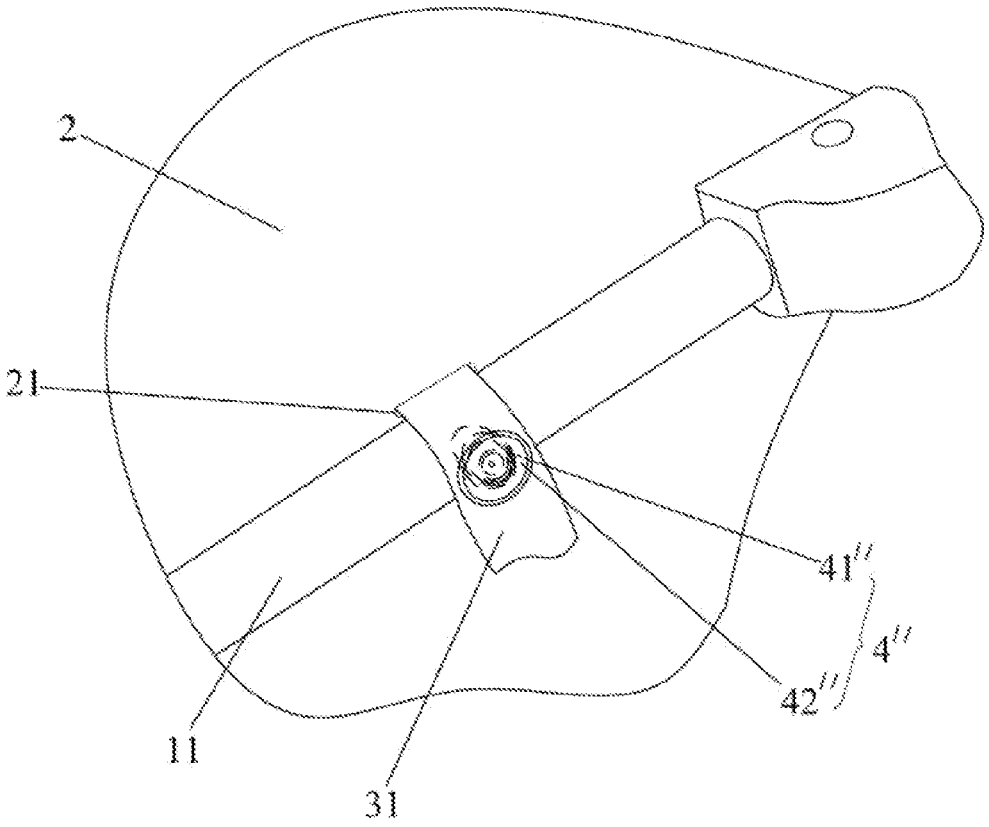
FIG. 11 is a partially enlarged view illustrating the attachment of the cushion pad shown in FIG. 9 with the support base of the baby crib.

FIGS. 9-11 are schematic views illustrating another variant embodiment for attaching the cushion pad 3 with the support base 2. Compared to the previous embodiments, the fastener 4" of the embodiment shown in FIGS. 9-11 can be implemented as a snap button fastener including a button 41" and a cap 42". The cap 42" can be affixed with the free end of the strap 31, and the button 41" can be affixed on the tube segment 11 of the frame structure 1. The button 41" and the cap 42" can lock with each other by snapping engagement to attach the cushion pad 3 with the support base 2.

At least one advantage of the structures described herein includes the ability to detachably fasten the cushion pad with the support base of the baby crib through multiple fasteners. The fasteners can attach multiple straps that can loop through the support base to securely hold the cushion pad with the support base of the baby crib. Accordingly, a child cannot accidentally lift the cushion pad from the base, and the baby crib can be safer in use.

Realizations of the structures of a baby crib have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the invention as defined in the claims that follow.

What is claimed is:

1. A baby crib comprising:

a frame structure including a frame segment;

a support base located at a bottom of the frame structure and above the frame segment, the support base including at least one opening; and a cushion pad disposed on the support base such that a portion of the support base adjacent to the opening is located between the frame segment and the cushion pad, the cushion pad including at least one strap disposed at a position corresponding to the opening, wherein the strap has a first end secured with the cushion pad, and a second end that forms a free end that is guided downward through the opening and detachably fastens around the frame segment of the frame structure via a fastener, whereby the cushion pad is anchored with the frame segment through the opening of the support base.

2. The baby crib according to claim 1, wherein the support base is supported on the frame segment of the frame structure which is formed by a tube segment, and the free end wraps at least partially around the tube segment.

3. The baby crib according to claim 2, wherein the fastener is a hook-and-loop fastener having a loop strip and a hook strip, the loop strip being provided at the free end of the strap, the hook strip being provided on the support base, the free end wrapping around the adjacent tube segment and the hook strip engaging with the loop strip.

4. The baby crib according to claim 2, wherein the cushion pad includes two of the strap disposed corresponding to the opening and respectively having two free ends, and the fastener is a buckle fastener including a male fastener and a female fastener respectively provided at the two free ends of the two straps, the two free ends respectively wrapping from two sides of the adjacent tube segment so that the male and female fasteners are engaged with each other.

5. The baby crib according to claim 2, wherein the fastener is a snap button fastener including a button and a cap that are respectively affixed with the tube segment and the free end of the strap, the button being configured to engage with the cap.

6. The baby crib according to claim 1, wherein the support base includes four of the openings.

7. The baby crib according to claim 6, wherein the four openings are disposed at four corners of the support base.

8. The baby crib according to claim 1, wherein the opening is located at a periphery of the support base.

9. The baby crib according to claim 1, wherein the strap is made of a webbing material.

10. The baby crib according to claim 9, wherein the first end of the strap is sewed with the cushion pad.

11. A baby crib comprising:

a frame structure having a frame segment arranged at a bottom of the frame structure;

a support base resting in contact against the frame segment in an interior of the frame structure, the support base including an outer border, and at least one opening that is formed through the support base within a region surrounded by the outer border and is located adjacent to the frame segment; and a cushion pad disposed on the support base such that a portion of the support base adjacent to the opening is located between the frame segment and the cushion pad, the cushion pad including at least one strap having a first and a second end, the first end being affixed with the cushion pad, and the second end forms a free end that is guided downward through the opening and detachably fastens around the frame segment via a fastener so as to anchor the cushion pad with the frame segment.

12. The baby crib according to claim 11, wherein the frame structure includes a plurality of corners, and the frame segment extends diagonally from one of the corners toward a center of the frame structure.

13. The baby crib according to claim 11, wherein the free end wraps at least partially around the frame segment.

14. The baby crib according to claim 11, wherein the fastener is a hook-and-loop fastener having a loop strip and a hook strip, the loop strip being provided at the free end of the strap, the hook strip being provided on the support base, the free end wrapping around the frame segment so that the hook strip engages with the loop strip.

15. The baby crib according to claim 11, wherein the cushion pad includes two of the strap disposed near the opening and respectively having two free ends, and the fastener is a buckle fastener including a male fastener and a female fastener respectively affixed with the two free ends of the two straps, the two free ends wrapping around the frame segment so that the male and female fasteners engage with each other.

16. The baby crib according to claim 11, wherein the fastener is a snap button fastener including a button and a cap that are respectively affixed with the frame segment and the free end of the strap, the button being configured to engage with the cap.

17. A baby crib comprising:

a frame structure having a plurality of corner, and a frame segment arranged at a bottom of the frame structure and extending diagonally from one of the corners toward a center of the frame structure;

a support base supported on the frame segment in an interior of the frame structure, the support base having one opening adjacent to the frame segment; and a cushion pad disposed on the support base such that a portion of the support base adjacent to the opening is located between the frame segment and the cushion pad, the cushion pad including at least one strap having a first and a second end, the first end being affixed with the cushion pad, and the second end forms a free end that is guided downward through the opening and detachably fastens around the frame segment via a fastener so as to anchor the cushion pad with the frame segment.

18. The baby crib according to claim 17, wherein the fastener is a hook-and-loop fastener having a loop strip and a hook strip, the loop strip being provided at the free end of the strap, the hook strip being provided on the support base, the free end wrapping around the frame segment so that the hook strip engages with the loop strip.

19. The baby crib according to claim 17, wherein the cushion pad includes two of the strap disposed near the opening and respectively having two free ends, and the fastener is a buckle fastener including a male fastener and a female fastener respectively affixed with the two free ends of the two straps, the two free ends wrapping around the frame segment so that the male and female fasteners engage with each other.

20. The baby crib according to claim 17, wherein the fastener is a snap button fastener including a button and a cap that are respectively affixed with the frame segment and the free end of the strap, the button being configured to engage with the cap.

* * * * *